US006077019A

United States Patent [19]

Corcoran

[11] Patent Number: 6,077,019

[45] Date of Patent: Jun. 20, 2000

[54] CARGO CONTAINER STORAGE AND RETRIEVAL SYSTEM AND METHOD

[75] Inventor: John Corcoran, Harwich, Mass.

[73] Assignees: Margaret A. Corcoran, Dennis; Mary A. Corcoran; Ellen T. Corcoran, both of Hyannis, all of Mass.

[21] Appl. No.: 08/891,541

[22] Filed: Jul. 11, 1997

[51] Int. Cl.[7] ..... B63B 27/00

[52] U.S. Cl. ..... 414/281; 414/808; 414/142.6; 414/143.2

[58] Field of Search ..... 414/281, 143.2, 414/808, 142.6

[56] References Cited

U.S. PATENT DOCUMENTS

| | | | |
|---|---|---|---|
| 2,929,520 | 3/1960 | Mellam | 414/142.6 |
| 3,380,422 | 4/1968 | Bachko | 414/143.2 |
| 3,468,437 | 9/1969 | Miller | 414/143.2 |
| 3,498,477 | 3/1970 | Sommer | 414/142.6 |
| 3,622,020 | 11/1971 | Sarvary | 414/281 |
| 3,730,358 | 5/1973 | Oji | 214/16.4 |
| 3,779,403 | 12/1973 | Young | 414/281 |
| 4,067,284 | 1/1978 | Yasushi et al. | 414/143.2 |
| 4,244,615 | 1/1981 | Brown | 294/67 D |
| 4,897,012 | 1/1990 | Brewer | 414/139.4 |
| 4,923,354 | 5/1990 | Giuliano et al. | 414/143.2 |
| 5,062,242 | 11/1991 | Corcoran | 52/36 |
| 5,140,787 | 8/1992 | Corcoran | 52/36 |
| 5,505,585 | 4/1996 | Hubbard | 414/139.4 |
| 5,860,783 | 1/1999 | Corcoran | 414/142.6 |

FOREIGN PATENT DOCUMENTS

| | | | |
|---|---|---|---|
| 0 109 950 A1 | 5/1984 | European Pat. Off. | B65G 1/10 |
| 0 252 822 A1 | 1/1988 | European Pat. Off. . | |
| 1177038 | 4/1959 | France | 414/143.2 |
| 2257966 | 1/1993 | United Kingdom | 414/281 |

*Primary Examiner*—Robert P. Olszewski
*Assistant Examiner*—Douglas A. Hess
*Attorney, Agent, or Firm*—Wolf, Greenfield & Sacks, P.C.

[57] ABSTRACT

The invention relates to a cargo container storage and retrieval system and method. One embodiment of a system according to the present invention includes a vessel having cargo hold with a plurality of bulkheads disposed along a width of the cargo hold to define a plurality of adjacent cells along a length of the cargo hold. The cargo hold is also equipped with a plurality of tiers along a depth of the cargo hold. The vessel also includes a deck having a plurality of hatch openings that are used to gain access to the cargo hold. In addition, the vessel includes a storage and retrieval system having a plurality of sets of parallel spaced tracks and a plurality of chassis seats disposed within each set of parallel space tracks. Each track of each set of parallel spaced tracks is mounted to a surface of a bulkhead of opposing bulkheads so that one set of parallel space tracks is disposed within each cell along the length of the cargo hold and so that a plurality of sets of parallel spaced tracks are disposed within each tier of the cargo. Each chassis seat has corresponding wheels that move along a corresponding set of parallel spaced tracks to provide a plurality of chassis seat along the width of the cargo hold for each set of parallel spaced tracks within each tier. Each chassis seat is equipped to hold a standardized cargo container. In addition, each set of parallel spaced tracks has an empty space of one chassis seat width. With this arrangement, at least one chassis seat may be moved along the corresponding set of parallel spaced tracks so that a standardized cargo container may be stored at or retrieved from any chassis seat position within any tier of the cargo hold of the vessel.

20 Claims, 5 Drawing Sheets

CARGO CONTAINER STORAGE AND RETRIEVAL SYSTEM AND METHOD

BACKGROUND OF THE INVENTION

1. Field of the Invention

The present invention relates to a storage and retrieval system and method for cargo containers and, more particularly, to the use and adaptation of this system in the conversion of existing vessels or storage facilities as well as in the construction of new vessels or storage facilities.

2. Description of the Related Art

It is to be understood that according to this disclosure a "container" is a standardized packing case for cargo in which goods can be safely stored and/or transported, by road, rail or sea. In the cargo container industry a size of the container has been standardized by the International Organization for Standardization. The container size that is used as a unit of measure is the 20-foot length container and, thus, the 20-foot equivalent unit (TEU) is the basic unit of measure used when making calculations of, for example, storage capacity. There are also standardized containers with lengths of 10, 30, 40 and 45 feet. The containers have also been standardized to a width of 8 feet and a height of 8 or 8.5 feet.

Economies of scale have led to the design and construction of containerships large enough to carry at least 6,000 TEU's. Thus, containerships and corresponding containers have evolved along with a wide array of handling equipment and apparatus. For example, container bridges, straddle carriers, stacking cranes, gantry cranes, toplift trucks, sidelift trucks, forklift trucks, vehicles utilized for moving the containers, and computer and tracking systems are just some of the adjuncts that have developed to service loading and unloading of containers and containerships. A containership can be loaded or discharged, for example, in a few days in spite of the fact that a containership carries more than twice as much cargo as a conventional vessel of the same size. Containerships are thus able to make more voyages and generate much higher profits in the course of a year than conventional vessels can. The manageability of these uniformly structured containers has encouraged production and commerce, promoted consumerism, and produced modem and diverse means of transportation.

A loaded containership typically has on its deck and deep into its cargo hold a thousand more standardized containers stacked on top of each other. Containerships typically have extremely wide hatchways which are essential so that the containers can be lowered into the cargo hold across the width of the ship, maneuvered vertically into cells and stacked on top of one another. The cells guide the containers into the hold and prevent the containers from shifting or tipping over at sea. However, the size of the hatchways also affects the ship's strength across the ship's deck area. Thus, in order to compensate for weaknesses in the ship's hull, girders are typically placed into the containership over bulkheads on the sides of the ship, in a girder construction, to add rigidity.

A beam of a containership or, in other words, a greatest width of a containership, its height from the water line to the uppermost deck in a loaded ship, as well as a ship's center of gravity are typically managed so that when the ship is correctly loaded, the ship has stability in heavy seas. In addition, a containership typically has a ballast system with a large double bottom, ballast side tanks and extensive high-performance pumps to ensure that the ship's balance or trim is maintained according to the cargo being carried. For example, the ship's inclination to heel to one side can be countered by flooding or draining the side ballast tanks or "counter trimming" as known to those of skill in the art. A heel compensating system typically pumps ballast water from one side tank to another side tank of the containership during loading and unloading of the containership so as to maintain trim of the containership. One of the reasons for this is because it is only possible to load or unload the containers from the cells of the ship when the containership is in an upright position. In addition, when a ship has an even keel, the ship has the least draft possible, which is an advantage when the ship is sailing in shallow waters.

These containerships typically also have a spreader that is used to lift up, carry and lower the containers into and out of the cargo hold of the containership. The spreader is equipped with four small twist lock receptacles that mate with four corresponding twist locks on the container and can be used to grip the top corners of the container, and, for example, by remote control, be interlocked with the container to accomplish the loading and unloading of the containers. Just as the container size is standardized, the twist locks and receptacles are typically standardized so that the containers can be handled by every port in the world equipped to do so.

The capital investment required for the construction of vessels of this size, however, has led to consolidation among shipping companies, and competition has led to the loss of lower profit feeder links and shuttles between smaller shipping ports. In addition to market pressures, shallow water ports cannot be serviced by these larger vessels, nor is it economically or logistically feasible to reestablish feeder links by replacing obsolete vessels with small, but much more expensive containerships. Because current containerships or smaller vessels do not permit convenient, instantaneous and systematic retrieval of shipboard containers, most of the world's smaller or shallow water ports are unable to reach their full potential.

SUMMARY OF THE INVENTION

Accordingly, in one embodiment a storage and retrieval system includes a plurality of tiers, a set of parallel spaced tracks disposed within each tier, and a plurality of chassis seats disposed within each set of parallel spaced tracks. The plurality of chassis seats within each set of parallel spaced tracks make up a plurality of chassis seat positions within each tier. Each chassis seat has corresponding wheels that move along the corresponding set of parallel spaced tracks and each chassis seat is equipped to hold a standardized cargo container. Each set of parallel spaced tracks has an empty space corresponding to a width of one chassis seat. With this arrangement, at least one chassis seat may be moved along the corresponding set of parallel spaced tracks so that a standardized cargo container may be stored at or retrieved from any chassis seat position within any tier of the storage and retrieval system.

One embodiment of a method of storing and retrieving a cargo container from any position with a stack of cargo containers according to the present invention includes providing a plurality of tiers, providing a set of parallel spaced tracks within each tier of the plurality of tiers and providing a plurality of chassis seats within each set of parallel spaced tracks, wherein each chassis seat has corresponding wheels so that each chassis seat may be moved along the corresponding set of parallel space tracks. In addition, each set of parallel spaced tracks within each tier is provided with an empty space corresponding to a width of one chassis seat.

With this method, at least one chassis seat may be moved along the corresponding set of parallel spaced tracks to the empty space so that the cargo container may be stored at or retrieved from any chassis seat position within any tier of the stack of cargo containers.

One embodiment of a vessel according to the present invention includes a cargo hold having a plurality of bulkheads disposed along a width of the cargo hold to define a plurality of adjacent cells along a length of the cargo hold. The cargo hold is also equipped with a plurality of tiers along a depth of the cargo hold. The vessel also includes a deck having a plurality of hatch openings that are used to gain access to the cargo hold. In addition, the vessel includes a storage and retrieval system having a plurality of sets of parallel spaced tracks and a plurality of chassis seats disposed within each set of parallel space tracks. Each track of each set of parallel spaced tracks is mounted to a surface of a bulkhead of opposing bulkheads so that one set of parallel spaced tracks is disposed within each cell along the length of the cargo hold and so that a plurality of sets of parallel spaced tracks are disposed within each tier of the cargo hold. Each chassis seat has corresponding wheels that move along a corresponding set of parallel spaced tracks to provide a plurality of chassis seats along the width of the cargo hold for each set of parallel spaced tracks within each tier. Each chassis seat is equipped to hold a standardized cargo container. In addition, each set of parallel spaced tracks has an empty space of one chassis seat width. With this arrangement, at least one chassis seat may be moved along the corresponding set of parallel spaced tracks so that the standardized cargo container may be stored at or retrieved from any chassis seat position within any tier of the cargo hold of the vessel.

Other objects and features of the present invention will become apparent from the following detailed description when taken in connection with the following drawings. It is to be understood that the drawings are for the purpose of illustration only and are not intended as a definition of the limits of the invention.

BRIEF DESCRIPTION OF THE DRAWINGS

The foregoing and other objects and advantages will be more fully appreciated from the following drawing in which.

DETAILED DESCRIPTION

The following description sets forth an embodiment of the invention, however, it is to be appreciated that various alterations, modifications and embodiments known to one of skill in the art and not specifically described herein are encompassed by the invention.

Figure 1:
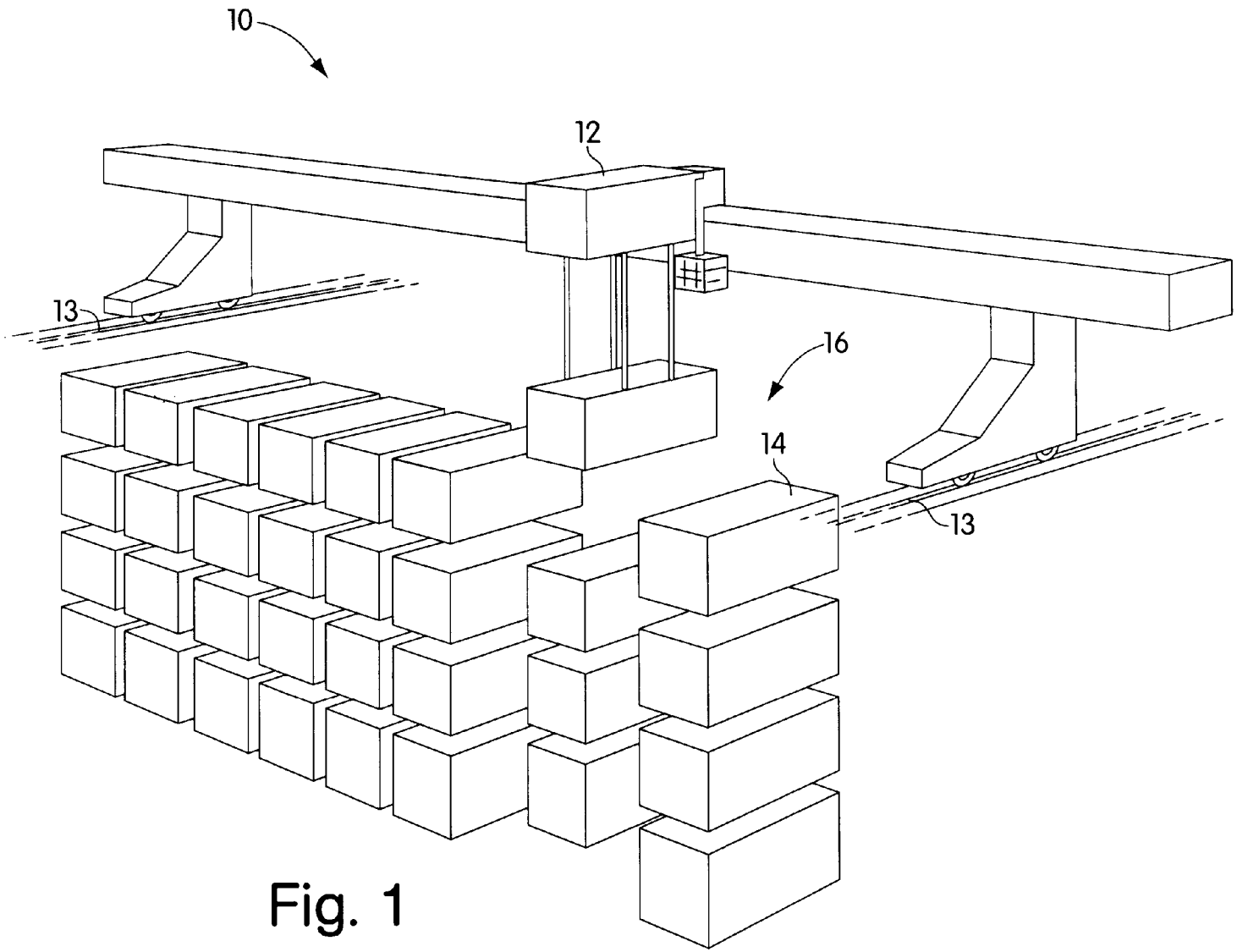
FIG. 1 is a schematic perspective view of a cargo container storage and retrieval system of the present invention.
Figure 2:
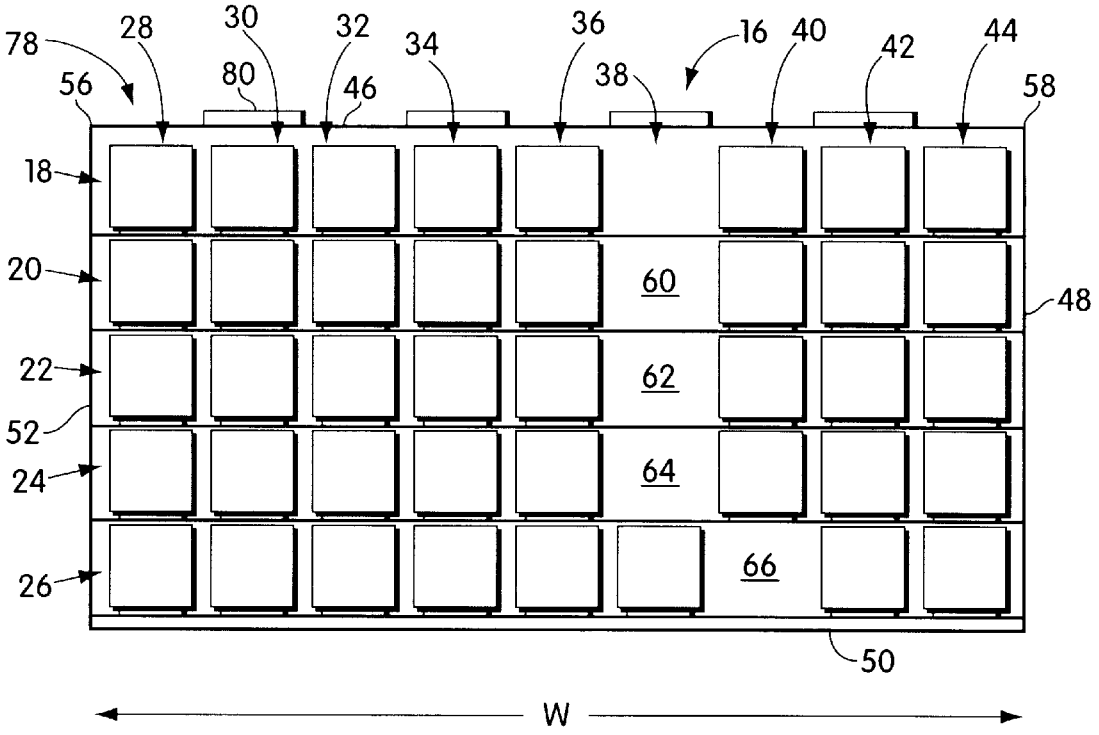
FIG. 2 is a cross-sectional view of a cargo hold of a cargo vessel equipped with the cargo container storage and retrieval of the present invention.

FIG. 1 illustrates a perspective view of an embodiment of a cargo container storage and retrieval system 10 of the present invention. FIG. 2 illustrates a cross-sectional view of a cargo hold of a cargo vessel equipped with an embodiment of the cargo container storage and retrieval system of the present invention. System 10 may include a mobile gantry crane 12 that slides along crane tracks 13, and that is used to load and retrieve any one of, or all of, a plurality of containers 14 stored within a cargo hold 16 of, for example, the cargo vessel (not illustrated). As will be explained in detail, infra, a mobile gantry crane in combination with the cargo container storage and retrieval system of the invention may be used to retrieve any container at any tier 18, 20, 22, 24 and 26 of the cargo hold and at any chassis seat position 28, 30, 32, 34, 36, 38, 40, 42 and 44 within any tier as shown in FIG. 2. The mobile gantry crane is known to those of skill in the art and can be used to enable users to load or off-load the containers. The containers, existing vessels and the mobile gantry crane are equipped with known implements, such as spreaders, twist locks and receptacles, that may be used by the crane operator and longshoremen to pick up and move the containers so that the containers may be placed into or removed from designated chassis seat positions within the cargo hold.

Figure 5:
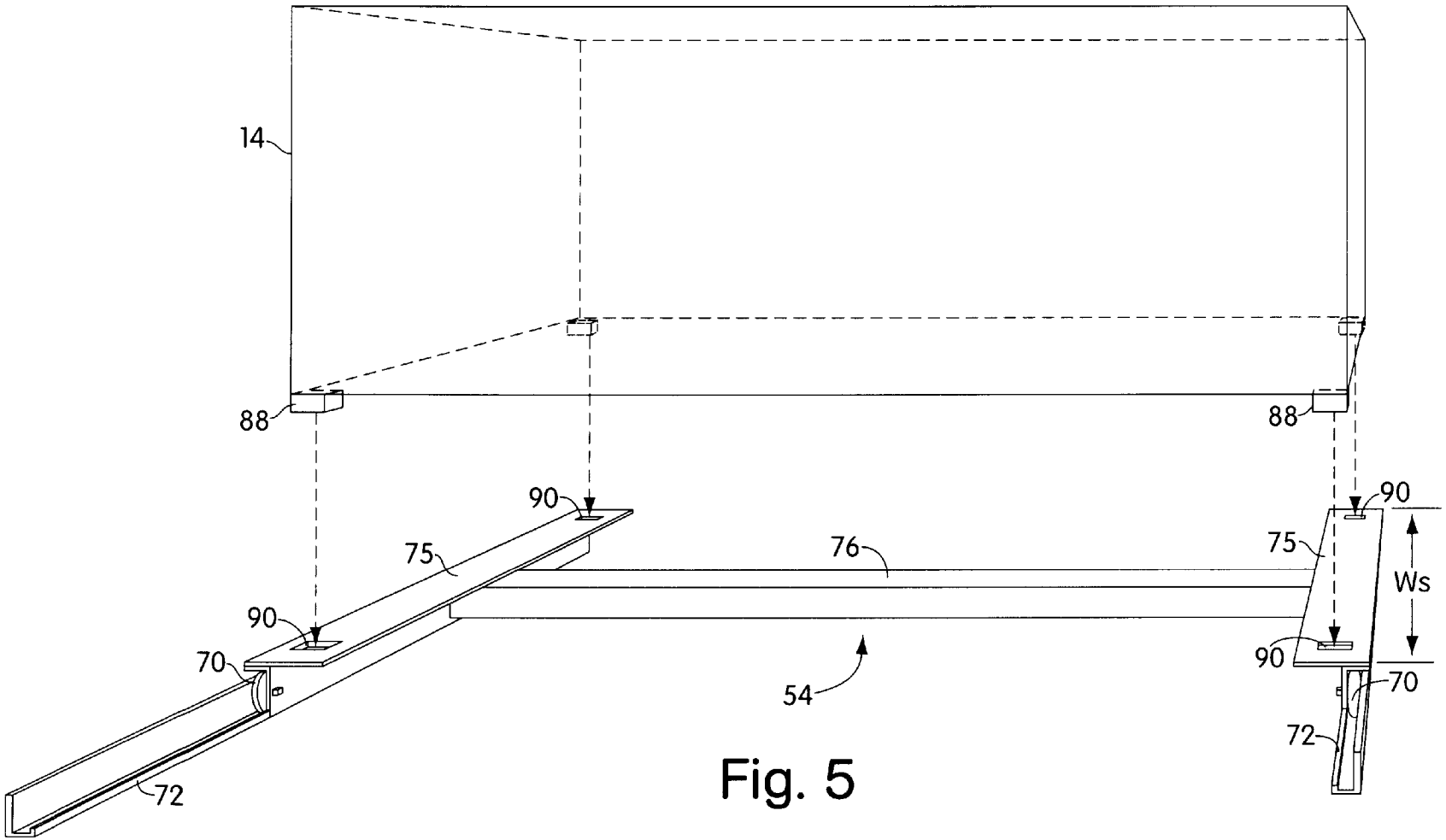
FIG. 5 is a schematic perspective view of an embodiment of a chassis seat for a container according to the container storage and retrieval system of the present invention.

Referring to FIG. 2 there is illustrated an example of an overall stacking plan for the containers that may be used according to an embodiment of the container storage and retrieval system of the present invention. A rectangular cargo hold 16 defined by borders 46, 48, 50 and 52 is provided within the containership or cargo vessel (not shown). It is to be appreciated that although the cargo hold has been illustrated as rectangular for purposes of the invention discussed herein, the cargo hold may be any other shape. A plurality of containers in movable chassis seats 54, as shown in FIG. 5, are arranged in tiers 18, 20, 22, 24 and 26 within the rectangular cargo hold, each tier comprising as many individual chassis seats as will fit across and within the width W of the cargo hold (e.g. the distance between points 56 and 58). One chassis seat position 38, 60, 62, 64 and 66 in each tier remains vacant so that any container within any tier can be retrieved by appropriate movement of the containers. Otherwise each tier comprises as many chassis seats as can possibly fit within the width of the rectangular cargo hold, thereby filling the entire width of the cargo hold in order to achieve maximum space utilization.

Figure 3:
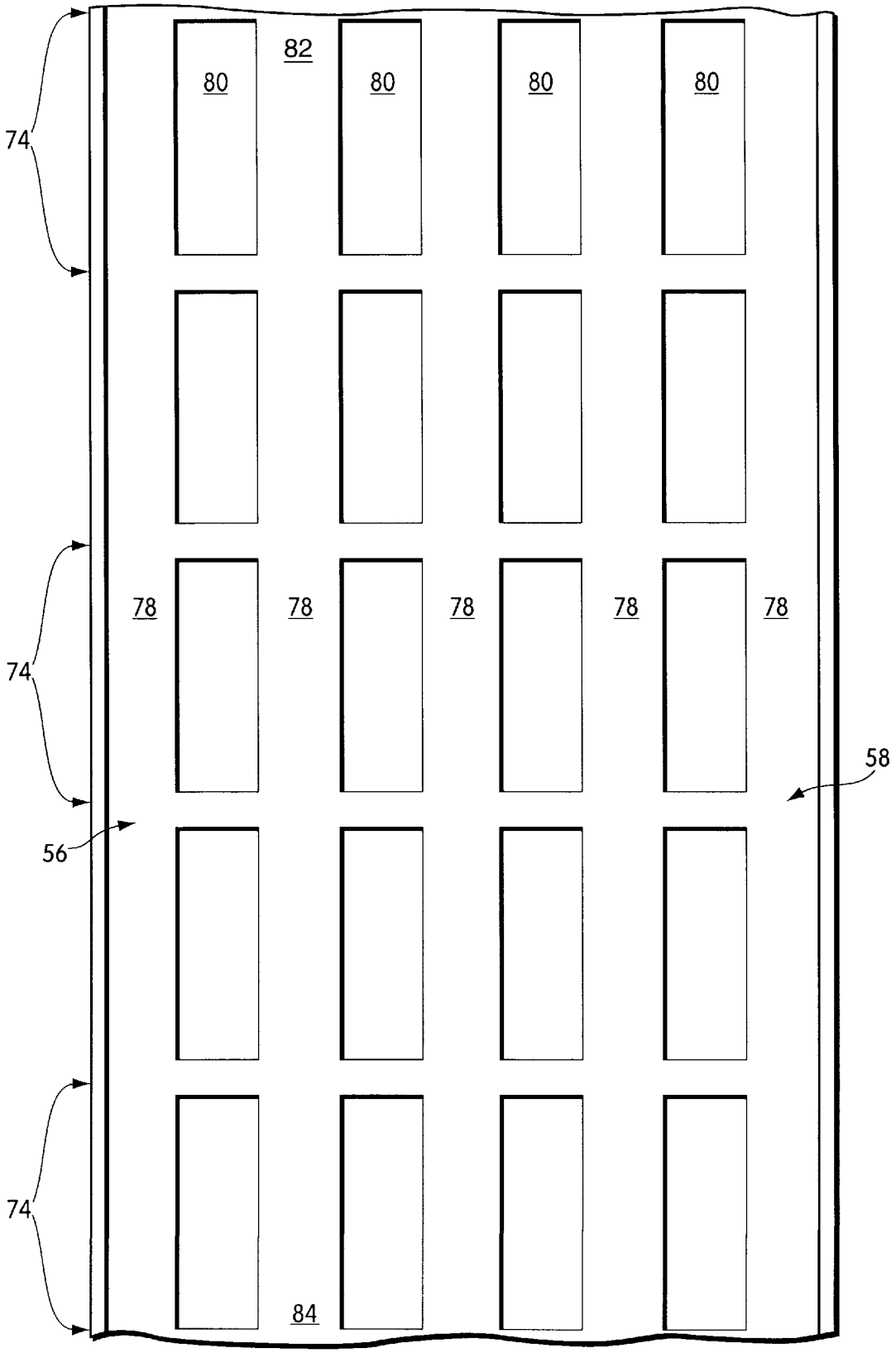
FIG. 3 is a top plan view of a cargo vessel looking down upon a deck having hatch openings into the cargo hold of the cargo vessel.
Figure 4:
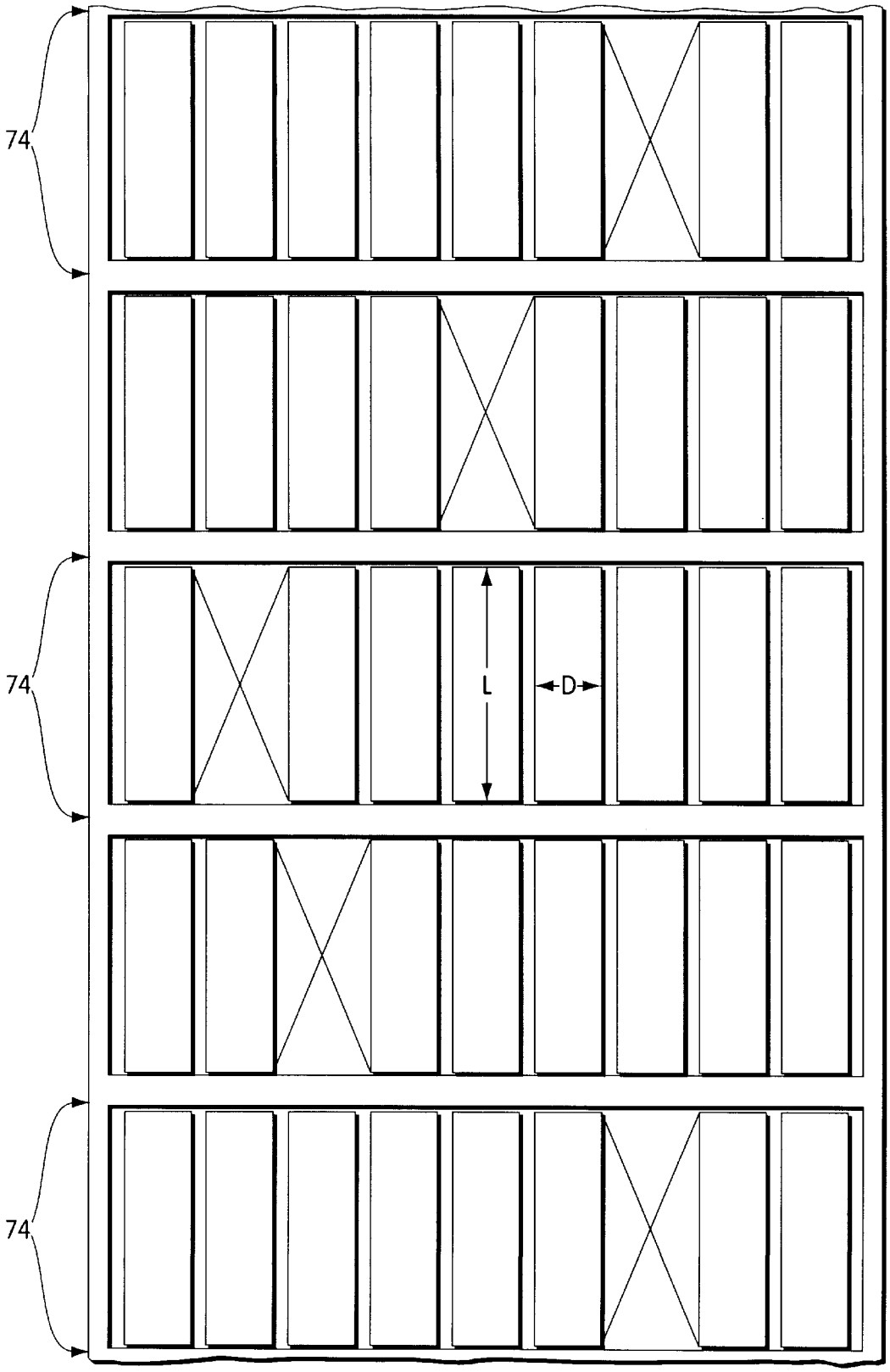
FIG. 4 is a top plan view looking down upon a plurality of stacked containers within the cargo hold of the cargo vessel.

Referring now to FIG. 5, there is illustrated an embodiment of the chassis seat 54 according to the storage and retrieval system of the invention. Each chassis seat in each tier is movable transversely along the width of the cargo hold (into and out of the page as illustrated in FIG. 5). Each chassis seat 54 includes a frame 75 with wheels 70 that may be mounted on ends of each frame and that roll upon a set of spaced parallel tracks 72 which are attached to each bulkhead 74 of the cargo hold of the cargo vessel at each tier level, as shown in FIGS. 3 and 4. It is to be appreciated that at least one set of spaced parallel tracks is provided between the width W of the cargo hold (as shown in FIG. 2) to coincide with the wheels of each chassis seat, and that additional sets of spaced parallel tracks between the width of the cargo hold may be provided within each tier along the length L of the cargo hold, as shown in FIG. 4.

As discussed above, the cargo hold is divided into tiers 18, 20, 22, 24 and 26. In a preferred embodiment of the cargo storage and retrieval system, a vertical spacing between each set of tracks in adjacent tiers is approximately 10 feet. The spacing of 10 feet is preferred so that the standardized containers having a height of 8 feet or 8.5 feet may be accommodated.

However, it is to be appreciated that any height that allows standardized containers to be accommodated can be used and is intended to be within the scope of this disclosure. It is also to be appreciated that a spacing of sets of parallel tracks along the length of the cargo hold within each tier can be selected to accommodate 45, 40, 30, 20 and/or 10 feet in length standardized containers. Further, it is to be appreciated that a width $W_S$ of each chassis seat, as shown in FIG. 5, is preferably approximately 9 feet to accommodate a standardized container having a width of 8 feet. However, it is to be appreciated that any size chassis seat that accommodates any standardized size containers of known dimensions known to those of skill in the art are intended to be within the scope of this disclosure.

In a preferred embodiment of the storage and retrieval system of the invention, each tier of chassis seats 54 is comprised of separate chassis seats for each container that are rollably movable along tracks 72 secured to transverse bulkheads 74. Each container 14 is positioned and secured to the chassis seat by, for example, four twist locks 88 at four comers of the container that can be interlocked with openings 90 positioned in frame 75 of the chassis seat manually or by a remote control. It is to be appreciated that although the chassis seat has been illustrated with openings for mating the twist locks of the container, the chassis seat can also be provided with twist locks that mate with corresponding openings on the container and that such modification to existing cargo containers and of the chassis seat is intended to be within the scope of this invention. Similar twist locks can also be provided either on the chassis seat or the containers for interlocking of abutting chassis seats or containers to each other while the vessel is in motion. In a preferred embodiment of the storage and retrieval system of the invention, a conventional motor assembly is provided to drive the movable chassis seats 54 in each tier along the tracks 72 attached to each bulkhead 74. In addition, a conventional remote control device for the motor assembly may also be provided for access to the user of the system outside the cargo hold area. The user can thus driveably move any chassis seat in any tier to any chassis seat position from a remote location. These conventional mechanisms are typically provided in order to achieve proper alignment of the chassis seat positions, within each tier, for storage and retrieval operations. The remotely controlled motor assembly may be mounted, for example, within a connecting beam 76 of each chassis seat. It is also to be appreciated that the individually movable chassis seats may be moved along the tracks to contribute to the seaworthiness and stability of the vessel such as, for example, when ballast adjustments are required.

Thus each individual chassis seat is separately driveable and the remote motor control is provided with a conventional selection device for separately driving each chassis seat independently of the other chassis seats. When the remote user wishes to gain access to any particular container in any particular tier, the user can thus separately drive the individual chassis seats to an appropriate position thereby arranging for the instantaneous and efficient retrieval of the targeted container. Storage of a container to any chassis seat, or retrieval of a container from any chassis seat, may therefore always be remotely controlled by the user.

FIG. 3 is a top view of a vessel looking down upon a deck having hatch openings into the cargo hold of the vessel. In addition, FIG. 4 is a top view looking down upon a plurality of stacked containers within the cargo hold of the vessel. Referring to FIG. 3, along the main deck 78 of the vessel, a series of hatches 80 are selectively disposed in order to provide efficient and instantaneous retrieval of any one and/or all of the containers 14 (as shown in FIGS. 1–2) stored within the cargo hold 16 of the ship. These selectively disposed hatches also make it possible to add reinforced longitudinal supports (between points 82 and 84) and transverse supports (between points 56 and 58) to the vessel thereby enhancing its seaworthiness by reinforcing the deck of the vessel.

In a preferred embodiment of the invention, as shown in FIG. 2, a hold of a vessel is equipped with 5 tiers with a vacant chassis seat position in each tier so that any container can be retrieved by aligning its position immediately below the closest hatch in the main deck. Each cargo hold is also equipped to have 9 chassis seat positions 28, 30, 32, 34, 36, 38, 40, 42 and 44 within each tier 18, 20, 22, 24 and 26 within the cargo hold 16. In addition, since access to any container within any chassis seat and within any tier of the cargo hold is desired, each tier is provided with one open chassis seat position wherein no container is disposed so that only 8 containers exist in any one tier. The vacant position in each tier allows each chassis seat and corresponding container to be moved a distance equivalent to one position along the width of the hold in either a port or a starboard direction. Thus, the storage and retrieval system of the invention permits the immediate retrieval of any container from any position within any tier either within the cargo hold of the vessel through any of the hatches 80 disposed on the main deck 78 of the vessel.

In one embodiment of the present invention, a container storage and retrieval system as described above may also be positioned on the main deck of the cargo vessel. The number of tiers that may be placed above the deck of the vessel will be limited only by the line of sight from the vessel's navigating bridge to the bow.

Thus, according to the present invention, an existing vessel can be modified and equipped with the system of the present invention so that any one container can be removed from or loaded onto the vessel. With this arrangement, existing cargo vessels can be converted into container carrying ships that may be used to service, for example, shallow water ports. Therefore, ports previously under-serviced or not accessible can be made accessible and commerce to all ports can be reestablished. In addition, feeder links, nitch trades and shuttles can then be reestablished as a result of open commerce to all of these ports.

Having thus described several particular embodiments of the invention, various alterations, modifications, and improvements will readily occur to those skilled in the art. For example, the storage and retrieval system and method for cargo containers can be used to convert existing warehouses or in the construction of new warehouses. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. A storage and retrieval system, comprising:

a plurality of tiers;

a plurality of sets of parallel spaced tracks disposed within each tier of the plurality of tiers;

a plurality of chassis seats disposed within each set of parallel spaced tracks to yield a plurality of chassis seat positions within each set of parallel spaced tracks and within each tier, each chassis seat having wheels that move along the corresponding set of parallel spaced tracks, and each chassis seat equipped to hold a standardized cargo container; and each set of parallel spaced tracks having an empty space corresponding to a dimension of one chassis seat, so that the chassis seats may be moved along the corresponding set of parallel spaced tracks so that a standardized cargo container may be stored at or retrieved from any chassis seat position within any set of parallel spaced tracks and within any tier of the storage and retrieval system, without having to remove any other standardized cargo container.

2. The storage and retrieval system as claimed in claim 1, wherein each chassis seat is provided with at least one opening that mates with a corresponding twist lock of a standardized cargo container.

3. The storage and retrieval system as claimed in claim 1, wherein each chassis seat is provided with at least one twist lock that mates with a corresponding opening of a standardized cargo container.

4. The storage and retrieval system as claimed in claim 1, wherein each chassis seat is provided with a motor assembly disposed within the chassis seat to drive the chassis seat along the corresponding set of parallel spaced tracks.

5. The storage and retrieval system as claimed in claim 4, further comprising a remote control that may be used to select any chassis seat and move a selected chassis seat along the corresponding set of parallel spaced tracks.

6. The storage and retrieval system as claimed in claim 1, wherein each chassis seat includes at least one twist lock that mates with a twist lock of an adjacent chassis seat so that the chassis seats may be locked together within each set of parallel spaced tracks.

7. A method of storing and retrieving a cargo container from any position within a storage and retrieval system including a plurality of cargo containers, comprising the steps of:

providing a plurality of tiers;

providing a plurality of sets of parallel spaced tracks within each tier of the plurality of tiers;

providing a plurality of chassis seats within each set of parallel spaced tracks to yield a plurality of chassis seat positions within each set of parallel spaced tracks and within each tier, each chassis seat having wheels so that each chassis seat may be moved along the corresponding set of parallel spaced tracks, and each chassis seat equipped to hold a cargo container;

providing each set of parallel spaced tracks with an empty space corresponding to a dimension of one chassis seat; and moving at least one chassis seat along the corresponding set of parallel spaced tracks to the empty space so that a cargo container may be stored at or retrieved from any chassis seat position within any set of parallel spaced tracks and within any tier of the cargo storage and retrieval system without having to remove any other cargo container.

8. The method of storing and retrieving a cargo container as claimed in claim 7, further comprising the step of placing a standardized cargo container within a chassis seat.

9. The method of storing and retrieving a cargo container as claimed in claim 7, further comprising the step of removing a standardized cargo container from a chassis seat.

10.A method of storing and retrieving a cargo container from any position within a storage and retrieval system including a plurality of cargo containers, comprising the steps of:

providing a plurality of tiers;

providing a set of parallel spaced tracks within each tier of the plurality of tiers;

providing a plurality of chassis seats within each set of parallel spaced tracks to yield a plurality of chassis seat positions with each set of parallel spaced tracks, each chassis seat having wheels so that each chassis seat may be moved along the corresponding set of parallel spaced tracks, and each chassis seat equipped to hold a cargo container;

providing each set of parallel spaced tracks with an empty space corresponding to a dimension of one chassis seat;

moving at least one chassis seat along the corresponding set of parallel spaced tracks to the empty space so that a cargo container may be stored at or retrieved from any chassis seat position within any tier of the storage and retrieval system;

placing a cargo container within a chassis seat; and locking the cargo container within the chassis seat with a remote controlled twist lock assembly.

11. A method of storing and retrieving a cargo container from an position within a storage and retrieval system including a plurality of cargo containers, comprising the steps of:

providing a plurality of tiers;

providing a set of parallel spaced tracks within each tier of the plurality of tiers;

providing a plurality of chassis seats within each set of parallel spaced tracks to yield a plurality of chassis seat positions within each set of parallel spaced tracks, each chassis seat having wheels so that each chassis seat may be moved along the corresponding set of parallel spaced tracks, and each chassis seat equipped to hold a cargo container;

providing each set of parallel spaced tracks with an empty space corresponding to a dimension of one chassis seat;

moving at least one chassis seat along the corresponding set of parallel spaced tracks to the empty space so that a cargo container may be stored at or retrieved from any chassis seat position within any tier of the store and retrieval system;

placing a cargo container within a chassis seat; and wherein the step of placing the container is undertaken above the plurality of cargo containers.

12. The method of storing and retrieving a cargo container as claimed in claim 11, further comprising the step of unlocking the standardized cargo container from the chassis seat with a remote controlled twist lock assembly.

13. A method of storing and retrieving cargo container from any position within a storage and retrieval system including plurality of cargo containers, comprising the steps of:

providing a plurality of tiers;

providing a set of parallel spaced tracks within each tier of the plurality of tiers;

providing a plurality of chassis seats within each set of parallel spaced tracks to yield a plurality of chassis seat positions within each set of parallel spaced tracks, each chassis seat having wheels so that each chassis seat may be moved along the corresponding set of parallel spaced tracks, and each chassis seat equipped to hold a cargo container;

providing each set of parallel spaced tracks with an empty space corresponding to a dimension of one chassis seat;

moving at least one chassis seat along the corresponding set of parallel spaced tracks to the empty space so that a cargo container may be stored at or retrieved from any chassis seat position within any tier of the storage and retrieval system;

removing a cargo container from a chassis seat; and wherein the step of removing the cargo container is undertaken above the plurality of cargo containers.

14. A storage and retrieval system for use with a vessel, the vessel having a cargo hold, a plurality of bulkheads disposed along a width of the cargo hold to define a plurality of adjacent cells along a length of the cargo hold, the cargo hold also having a plurality of tiers within each cell into a depth of the cargo hold, and the vessel also having a deck having a plurality of hatch openings to gain access to the cargo hold of the vessel, the storage and retrieval system comprising:

a plurality of sets of parallel spaced tracks, each track of each set of parallel spaced tracks being mounted to a surface of a bulkhead of opposing bulkheads so that one set of parallel spaced tracks is disposed within each tier, and so that a plurality of sets of parallel spaced tracks are disposed into the depth and within each cell;

a plurality of chassis seats disposed within each set of parallel spaced tracks, each chassis seat having corresponding wheels that move along a corresponding set of parallel spaced tracks to comprise a plurality of chassis seats along the width of the cargo hold for each set of parallel spaced tracks within each tier, each chassis seat being equipped to hold a standardized cargo container; and each set of parallel spaced tracks having an empty space of one chassis seat width so that the chassis seats may be moved along the corresponding set of parallel spaced tracks and so that the standardized cargo container may be stored at or retrieved from any chassis seat position within any tier of the cargo hold of the vessel.

15. The vessel as claimed in claim 14, further comprising a mobile gantry crane to carry the standardized cargo containers and to place or remove the standardized cargo containers in the any chassis seat position within the any tier of the cargo hold.

16. The vessel as claimed in claim 15, wherein the mobile gantry crane is equipped with twist lock receptacles that engage corresponding twist locks on the standardized cargo containers to hold the standardized cargo containers.

17. The storage and retrieval system as claimed in claim 14, wherein each chassis seat is provided with at least one opening that mates with a corresponding twist lock of a standardized cargo container.

18. The storage and retrieval system as claimed in claim 14, wherein each chassis seat is provided with a motor assembly disposed within the chassis seat to drive the chassis seat along the corresponding set of parallel spaced tracks.

19. The storage and retrieval system as claimed in claim 18, further comprising a remote control that may be used to select any chassis seat and move a selected chassis seat along the corresponding set of parallel spaced tracks.

20. The storage and retrieval system as claimed in claim 14, wherein each chassis seat includes at least one twist lock that mates with a twist lock of an adjacent chassis seat so that the chassis seats may be locked together within each set of parallel spaced tracks.

* * * * *